US007188784B1

(12) United States Patent
Mullins et al.

(10) Patent No.: US 7,188,784 B1
(45) Date of Patent: Mar. 13, 2007

(54) AUTOMATIC RAIN GUTTER FLUSHING SYSTEM

(76) Inventors: Michael S. Mullins, 11510 Cypress Reserve, Tampa, FL (US) 33626; Phyllis J. Mullins, 8434 Boxwood Dr., Tampa, FL (US) 33615

( * ) Notice: Subject to any disclaimer, the term of this patent is extended or adjusted under 35 U.S.C. 154(b) by 0 days.

(21) Appl. No.: 11/182,519

(22) Filed: Jul. 15, 2005

Related U.S. Application Data

(60) Provisional application No. 60/588,637, filed on Jul. 17, 2004.

(51) Int. Cl.
*B05B 3/00* (2006.01)

(52) U.S. Cl. ..... 239/208; 239/70; 239/266; 239/289; 239/550; 239/570; 239/574; 239/DIG. 15; 134/166 R; 134/167 C; 52/11; 52/16

(58) Field of Classification Search ..... 239/67, 239/70, 200, 208, 266, 267, 289, 550, 551, 239/562, 570, 571, 574, DIG. 15; 52/11, 52/12, 16; 134/166 C, 166 R, 167 C
See application file for complete search history.

(56) References Cited

U.S. PATENT DOCUMENTS

| | | | | | |
|---|---|---|---|---|---|
| 4,183,368 | A * | 1/1980 | Husted | 134/166 R |
| 4,363,335 | A * | 12/1982 | Tapper | 134/167 C |
| 4,634,312 | A * | 1/1987 | Sterzel | 52/11 |
| 5,234,163 | A * | 8/1993 | Fritz | 239/70 |
| 5,406,966 | A * | 4/1995 | Lepkowski et al. | 134/166 R |
| 5,727,350 | A * | 3/1998 | Marcella | 239/208 |
| 6,076,307 | A * | 6/2000 | Kean | 239/208 |
| 6,467,995 | B2 * | 10/2002 | Bevilacqua et al. | 52/11 |
| 6,926,210 | B2 * | 8/2005 | Baxter | 239/208 |

* cited by examiner

*Primary Examiner*—Steven J. Ganey
(74) *Attorney, Agent, or Firm*—Edward P. Dutkiewicz

(57) ABSTRACT

An eave gutter is provided. A downspout is operatively coupled to the gutter. A plurality of spraying components has fittings and nozzles. The fittings and nozzles are positioned at spaced locations along the gutter. A conduit couples a fluid source and the fittings and nozzles to provided fluid to the gutter. Control components are provided along the conduit to the fittings and nozzles.

1 Claim, 3 Drawing Sheets

FIG 2
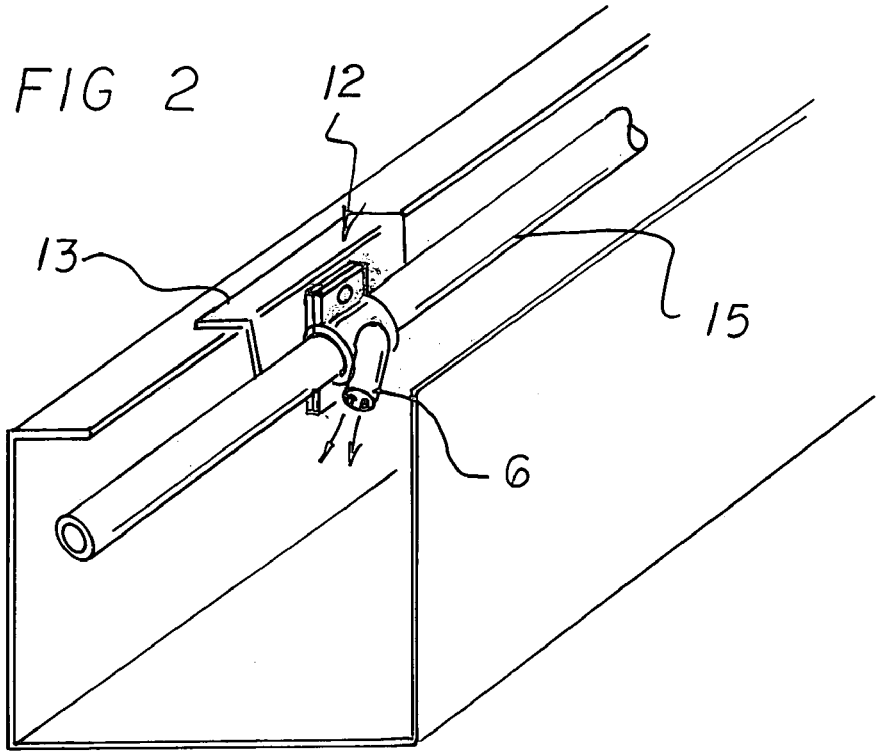
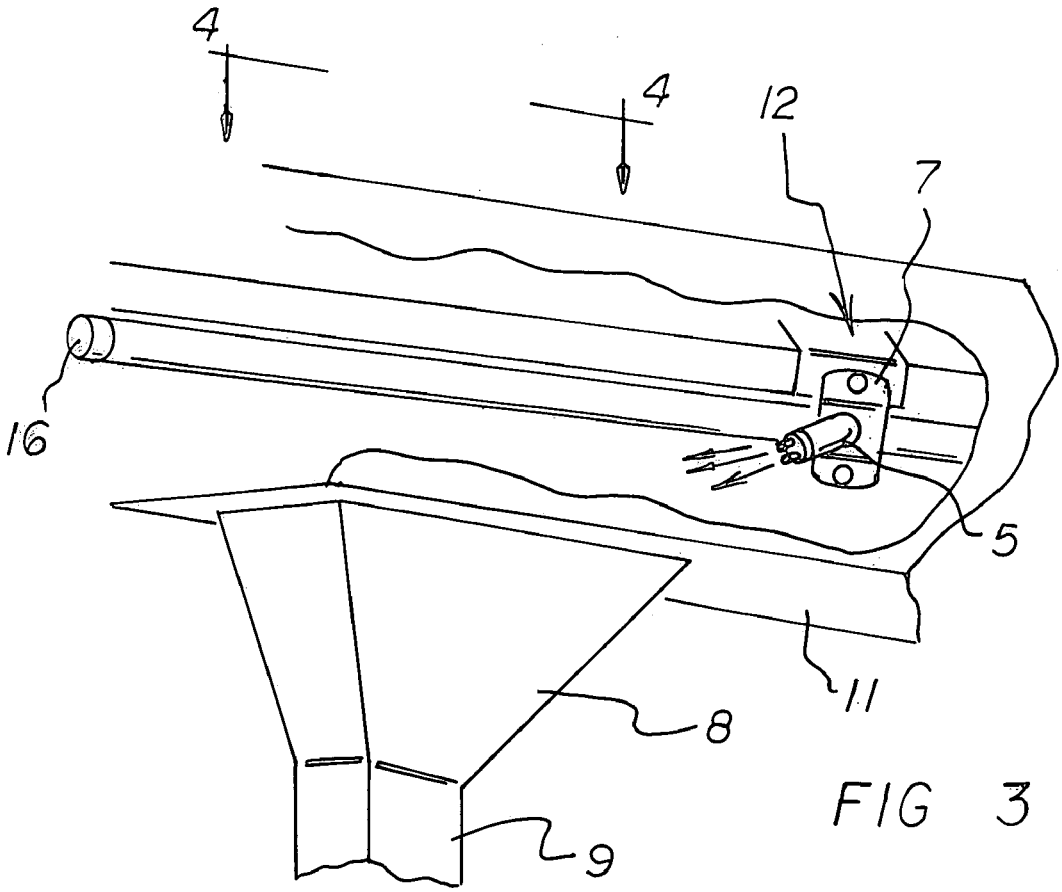
FIG 3

FIG 4
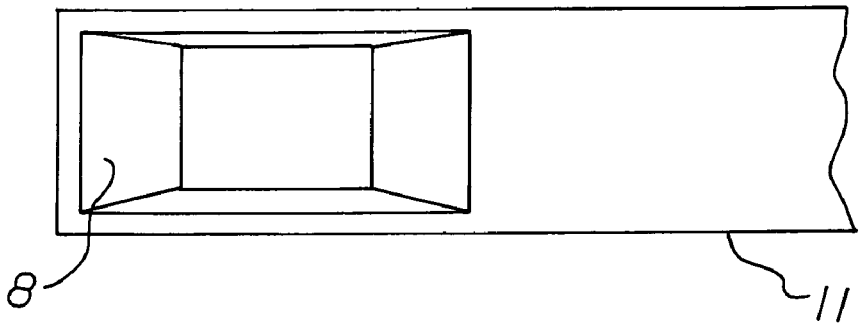
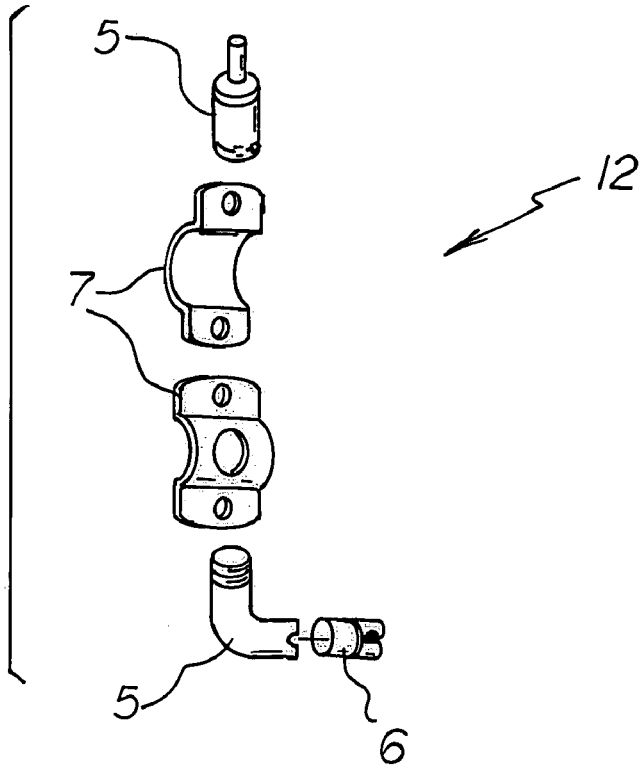
FIG 5

AUTOMATIC RAIN GUTTER FLUSHING SYSTEM

RELATED APPLICATION

The present application is based upon U.S. Provisional Application Ser. No. 60/588,637 filed Jul. 17, 2004.

BACKGROUND OF THE INVENTION

1. Field of the Invention

The present invention relates to an automatic rain gutter flushing system and more particularly pertains to automatically cleaning and flushing leaves and other debris from gutters and downspouts.

2. Description of the Prior Art

The use of gutter systems of known designs and configurations is known in the prior art. More specifically, gutter systems of known designs and configurations previously devised and utilized for the purpose of removing debris from gutters through known methods and configurations are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe an automatic rain gutter flushing system that allows automatically cleaning and flushing leaves and other debris from gutters and downspouts.

In this respect, the automatic rain gutter flushing system according to the present invention substantially departs from the conventional concepts and designs of the prior art, and in doing so provides an apparatus primarily developed for the purpose of automatically cleaning and flushing leaves and other debris from gutters and downspouts.

Therefore, it can be appreciated that there exists a continuing need for a new and improved automatic rain gutter flushing system which can be used for automatically cleaning and flushing leaves and other debris from gutters and downspouts. In this regard, the present invention substantially fulfills this need.

SUMMARY OF THE INVENTION

In view of the foregoing disadvantages inherent in the known types of gutter systems of known designs and configurations now present in the prior art, the present invention provides an improved automatic rain gutter flushing system. As such, the general purpose of the present invention, which will be described subsequently in greater detail, is to provide a new and improved automatic rain gutter flushing system and method which has all the advantages of the prior art and none of the disadvantages.

To attain this, the present invention essentially comprises an automatic rain gutter flushing system. First provided is an eave gutter. The gutter is positionable in proximity to the periphery of a roof of a building. In this manner water, leaves and other debris are directed.

A standard 3 inch by 4 inch downspout is provided. The downspout has an upper end. The upper end is coupled with respect to the gutter. The downspout has a lower end. The lower end directs water and leaves and other debris to a remote location. The downspout has a generally cone shaped enlarged drop outlet. The drop outlet operatively couples the upper end of the downspout and the gutter.

Provided next is a plurality of spraying components. Each of the spraying components includes a 90 degree directional fitting coupled with a spray nozzle. A mounting bracket is provided. The mounting bracket is secured to the gutter. A split eye connector is provided. The split eye connector couples a fitting with a mounting bracket. Each fitting and an associated mounting bracket and split eye connector are positioned at spaced locations along the gutter. In this manner a flow of water is directed along with leaves and other debris along the gutter and down the outlet and downspout.

A water source is provided next. The water source has a conduit. The conduit couples the water source and the fittings. In this manner water is provided to the gutter for moving leaves and other debris along the gutter and down the drop outlet and downspout during operation and use.

Further provided are control components. The control components are provided along the conduit sequentially from the water source to the fittings. The control components include a control valve. The control components include an anti-siphon valve. The control components also include a one-way check valve. Further included in the control components is an electric water pressure pump. The control components are adapted to control the flow of water from the water source to the fittings and gutter.

Provided last is an electronic timer. The electronic timer operatively couples the control valve and the electric water pressure pump. An electric power source is provided. The electric power source powers the electronic timer and the electric water pressure pump.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic rain gutter flushing system which has all of the advantages of the prior art gutter systems of known designs and configurations and none of the disadvantages.

It is another object of the present invention to provide a new and improved automatic rain gutter flushing system which may be easily and efficiently manufactured and marketed.

It is a further object of the present invention to provide a new and improved automatic rain gutter flushing system which is of durable and reliable constructions.

An even further object of the present invention is to provide a new and improved automatic rain gutter flushing system which is susceptible of a low cost of manufacture with regard to both materials and labor, and which accordingly is then susceptible of low prices of sale to the consuming public, thereby making such automatic rain gutter flushing system economically available to the buying public.

Even still another object of the present invention is to provide an automatic rain gutter flushing system for automatically cleaning and flushing leaves and other debris from gutters and downspouts.

Lastly, it is an object of the present invention to provide a new and improved automatic rain gutter flushing system. An eave gutter is provided. A downspout is operatively coupled to the gutter. A plurality of spraying components has fittings and nozzles. The fittings and nozzles are positioned at spaced locations along the gutter. A conduit couples a fluid source and the fittings and nozzles to provided fluid to the gutter. Control components are provided along the conduit to the fittings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of a portion of the system shown in FIG. 1.

FIG. 3 is a perspective view showing additional detail of the mounting of the fluid delivery system, and spraying components in the eave trough or gutter, along with the enlarged downspout.

FIG. 4 is a plan view of the enlarged drop outlet.

FIG. 5 is a perspective view of the split eye connector, 90 degree directional fitting and spray nozzle, these, along with the mounting bracket make up the spraying components.

The same reference numerals refer to the same parts throughout the various Figures.

DESCRIPTION OF THE PREFERRED EMBODIMENT

Figure 1:
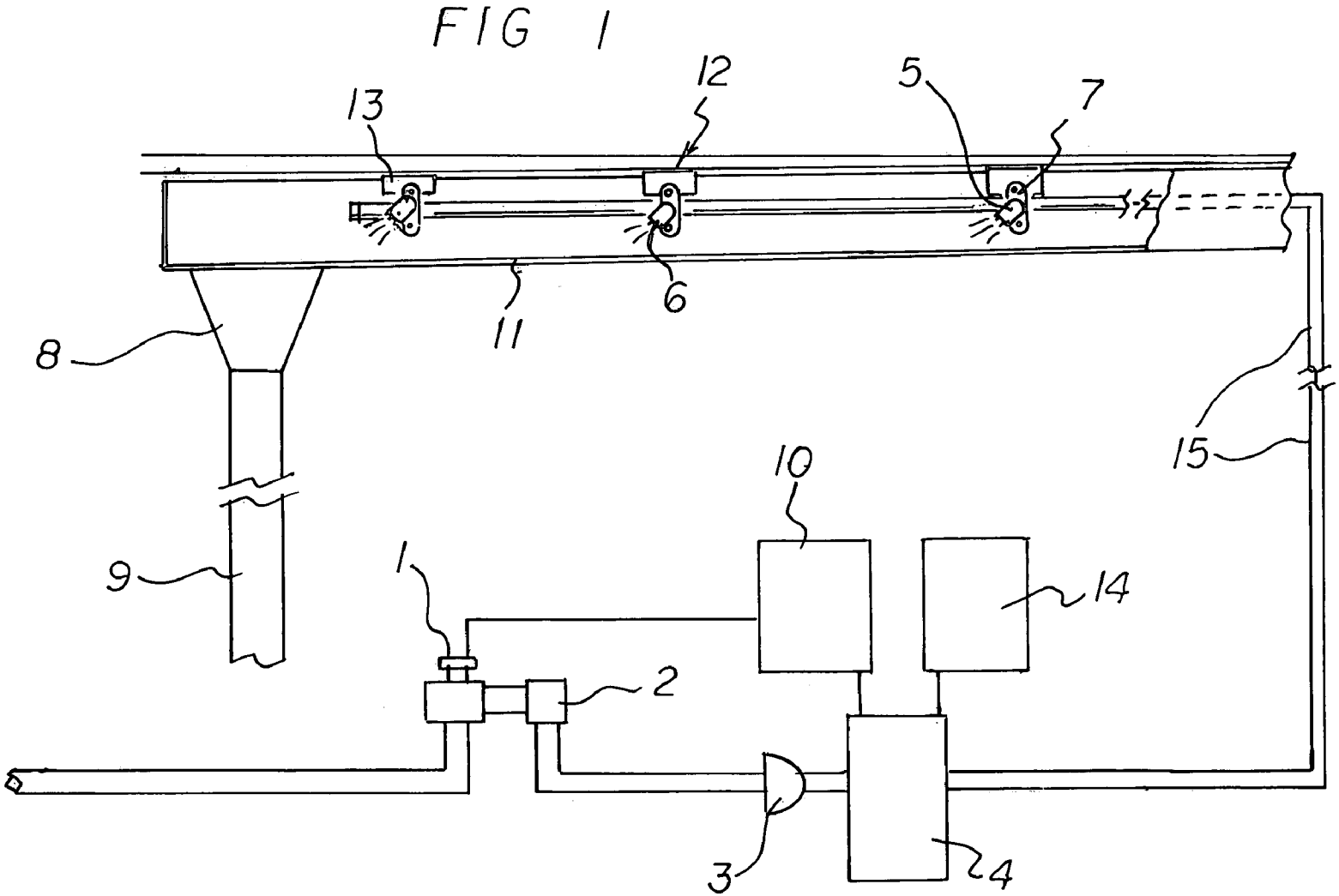
FIG. 1 is a side elevational view of an automatic rain gutter flushing system constructed in accordance with the principles of the present invention.

With reference now to the drawings, and in particular to FIG. 1, thereof, the preferred embodiment of the new and improved automatic rain gutter flushing system embodying the principles and concepts of the present invention will be described.

The present invention, the automatic rain gutter flushing system is comprised of a plurality of components. Such components in their broadest context include a gutter, a downspout, spraying components, a conduit and control components. Such components are individually configured and correlated with respect to each other so as to attain the desired objective.

First provided is an eave gutter 11. The gutter is positionable in proximity to the periphery of a roof of a building. In this manner water, leaves and other debris are directed.

A standard 3 inch by 4 inch downspout 9 is provided. The downspout has an upper end. The upper end is coupled with respect to the gutter. The downspout has a lower end. The lower end directs water and leaves and other debris to a remote location. The downspout has a generally cone shaped enlarged drop outlet 8. The drop outlet operatively couples the upper end of the downspout and the gutter.

Provided next is a plurality of spraying components 12. Each of the spraying components includes a 90 degree directional fitting 5 which is coupled with a spray nozzle 6. A mounting bracket 13 is provided. The mounting bracket is secured to the gutter. A split eye connector 7 is provided. The split eye connector couples a fitting with a mounting bracket. Each fitting and an associated mounting bracket and split eye connector are positioned at spaced locations along the gutter. In this manner a flow of water is directed along with leaves and other debris along the gutter and down the outlet and downspout.

A water source is provided next. The water source has a conduit 15. The conduit couples the water source and the fittings and terminates in end cap 16. In this manner water is provided to the gutter for moving leaves and other debris along the gutter and down the drop outlet and downspout during operation and use.

Further provided are control components. The control components are provided along the conduit sequentially from the water source to the fittings. The control components include a control valve 1. The control components include an anti-siphon valve 2. The control components also include a one-way check valve 3. Further included in the control components is an electric water pressure pump 4. The control components are adapted to control the flow of water from the water source to the fittings and gutter.

Provided last is an electronic timer 10. The electronic timer operatively couples the control valve and the electric water pressure pump. An electric power source 14 is provided. The electric power source powers the electronic timer and the electric water pressure pump.

The invention herein relates to a system, that, in part, is mounted to the inside of an eave trough, or more commonly known as a rain gutter, and that operates automatically to clean and flush leaves and other debris from said gutter and downspout attached thereon. The invention is directed to a fluid delivery tube or pipe mounted on or attached to the eave trough or gutter and containing a plurality of fluid jets or nozzles attached to a fluid delivery tube or pipe which are positioned so as to direct pressurized fluid into said eave trough or gutter in a manner as to force leaves and other accumulated debris contained therein toward and into the downspout(s); and is attached to a series of fluid delivery control devices. All is attached by means of tubing or pipes to either a pressurized or non-pressurized fluid source. Said control devices consist of an electronic timer with battery back-up, 24 volt DC electrically activated solenoid control valve, a anti-siphon valve, a 110 or 220 AC electrical source with appropriate circuit breakers, appropriate wiring necessary to properly connect the electrically operated or powered devices to the appropriate power supply or to each other, a one way fluid check valve, a 110 or 220 AC electrically powered fluid Jet pump, and a timer activated pump relay or other fluid pump switching and control device. In addition, attached to the eave trough or gutter is a device that effectively enlarges the opening in the eave trough or gutter to 3 inches wide by 8 inches long, centered in the bottom of said eave trough or gutter, to which the down spout is connected. Accordingly, the general objects of the present invention are to provide novel and improved apparatus of such character.

FIG. 1 is a side elevation of an eave trough or gutter and downspout flushing system according to the present invention as shown operationally with all of the various devices there as would be installed on or near a structure or building.

FIG. 2 is an end perspective view showing the eave trough or gutter as it is typically mounted on a structure or building with the fluid delivery tube and jet or nozzles mounted therein.

FIG. 3 is a perspective view showing additional detail of the mounting of the fluid delivery tube or pipe in the eave trough or gutter as shown in FIG. 1, items 6, 12, 13, and 15 and the position and direction of pressurized fluid as it exits from the jets or nozzles while FIG. 4 is a perspective view of the enlarged drop outlet and FIG. 5 is a perspective view of the components making up the spraying system.

While the invention is susceptible to various modifications and various alternative constructions, the drawings show in detail the preferred or best known mode of the invention. The drawings are not intended to limit the invention to the specific form disclosed herein. On the contrary, it is intended that the scope of this patent include all modifications and alternative constructions thereof falling with the spirit and scope of the invention as expressed the accompanying descriptions and drawings.

Referring to FIG. 1, the fluid supply line 15 is attached to the building or structure which is in turn attached to the spraying components 12 in the eave trough or gutter. The eave trough or gutter 11 is drained by a downspout 9 which is attached to the eave trough or gutter 11 by an enlarged drop outlet 8. Attached to the upper part of the eave trough or gutter is the fluid jet or nozzle 6, pressurizable fluid conduit 15 and bracket 13 used to attach same to the eave trough or gutter 11. Also included with the fluid jets or nozzles 6 is the directional nature of these jets or nozzles showing anticipated fluid flow direction that is used to direct the accumulated debris to the enlarged drop outlets 8 for evacuation into and through the downspout 9. Some installations with reduced water pressure, such as those using well water, may require a reduction fitting to reduce the inside conduit diameter incrementally thus increasing water pressure. The fluid conduit connects at the water source on one end and is attached to the gutter flushing system with associated spraying components 12 located in the gutter eave trough at the other.

The following control components consisting of the control valve 1, anti-siphon valve 2, one-way check valve 3, and electric water pressure pump 4, are located between the water source and the spraying components. The jet or pressure pump 4, is used to boost water pressure from a water source whose pressure is less than 50 psi. The pump is electrically powered and can be of any convenient or available AC electrical voltage or amperage. Operation of the pump is controlled by the electronic timer 10.

The timer is electrically powered with battery backup and operates electrical output circuits of 24 volts DC. The timer is used to set the frequency and duration of the operation of the invention and for controlling on and off modes of the operation of the pump 4 and control valve 1. The one-way check valve 3 and the anti-siphon valve 2 are included to ensure the protection from backflow contamination of any potable fluid supply to which the system may be connected. Fluid source can be any convenient source of fluid, either pressurized or not.

Attention is called to FIG. 2 which shows a typical fluid jet or nozzle 6 and pressuizable tubing or pipe 15 installed in the eave trough or gutter 11. Note the mounting or attachment position of the fluid jets or nozzles 6 and the pressuizable tube or pipe 15 in the upper outside edge of the eave or gutter 11 and pressurized fluid flow and direction as it exits from the jets or nozzles.

FIG. 3 is another view of the fluid trough or gutter and the fluid jets or nozzle fitting together with the 90 degree directional fitting. These are attached to the pressuizable tubing via the split eye connector. The entire flushing system is then attached to the eave trough or gutter via the mounting bracket. Also shown is a view of the direction of the pressurized fluid exiting the nozzles and pushing debris toward and into the enlarged drop outlet.

FIG. 4 is an overhead view of the enlarged drop outlet. The dimensions of the opening are to be a minimum of 3 inches on the wide axis of the eave trough or gutter.

FIG. 5 shows in detail the fluid jet nozzles attached to its 90 degree directional fitting and split eye connector.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic rain gutter flushing system which automatically operates to clean and flush leaves and other debris from gutters and downspouts comprising, in combination:

an eave gutter positionable in proximity to a periphery of a roof of a building to receive and direct water as well as leaves and other debris;

a standard 3 inch by 4 inch downspout having an upper end coupled with respect to the gutter and a lower end for directing water and leaves and other debris to a remote location and with a generally cone shaped enlarged drop outlet operatively coupling the upper end of the downspout and the gutter;

a plurality of spraying components, each of the spraying components including a 90 degree directional fitting with a mounting bracket secured to the gutter and split eye connector coupling an associated fitting with an associated mounting bracket and a spray nozzle, the nozzle being coupled with the fitting and the fitting being coupled with the conduit; the fitting held in place with the gutter by the split eye connector, each fitting and an associated mounting bracket and split eye connector and spray nozzle being positioned at spaced locations along the gutter to direct a flow of water along with leaves and other debris along the gutter and down the outlet and downspout;

a water source with a conduit coupling the water source and the fittings for providing water to the gutter for moving leaves and other debris along the gutter and down the drop outlet and downspout during operation and use;

control components along the conduit sequentially from the water source to the fittings including a control valve and an anti-siphon valve and a one-way check valve and an electric water pressure pump, the control components adapted to control the flow of water from the water source to the fittings and gutter; and an electronic timer operatively coupling the control valve and the electric water pressure pump with an electric power source powering the electronic timer and the electric water pressure pump.

* * * * *